US007115803B2

(12) United States Patent
Machida

(10) Patent No.: US 7,115,803 B2
(45) Date of Patent: Oct. 3, 2006

(54) STRINGED INSTRUMENT

(75) Inventor: Kazuo Machida, Tokyo (JP)

(73) Assignee: Taiyou Gakki Co., Ltd., Tokyo (JP)

( * ) Notice: Subject to any disclaimer, the term of this patent is extended or adjusted under 35 U.S.C. 154(b) by 166 days.

(21) Appl. No.: 10/933,322

(22) Filed: Sep. 3, 2004

(65) Prior Publication Data

US 2005/0051019 A1 Mar. 10, 2005

(30) Foreign Application Priority Data

Sep. 5, 2003 (JP) ..... 2003-314527

(51) Int. Cl.
*G10G 3/00* (2006.01)

(52) U.S. Cl. ..... 84/294; 84/726; 84/267; 84/290

(58) Field of Classification Search ..... 84/294–296, 84/726, 269, 276, 1, 267, 290; 984/370
See application file for complete search history.

(56) References Cited

U.S. PATENT DOCUMENTS 2,020,557 A 11/1935 Loar
2,968,204 A * 1/1961 Fender ..... 84/726
3,177,283 A * 4/1965 Fender ..... 84/726
3,780,202 A 12/1973 Law
3,992,972 A * 11/1976 Rickard ..... 84/743
5,422,432 A * 6/1995 Lace ..... 84/726
5,602,352 A * 2/1997 Huff ..... 84/291
6,040,510 A * 3/2000 Yaun ..... 84/294
6,103,961 A * 8/2000 Kaufman ..... 84/291
7,015,390 B1 * 3/2006 Rogers ..... 84/723
2004/0149120 A1 * 8/2004 Maruhashi et al. ..... 84/411 R

FOREIGN PATENT DOCUMENTS

DE 199-11-968 A 9/2000
JP 7-31275 7/1995

* cited by examiner

*Primary Examiner*—Gary F. Paumen
(74) *Attorney, Agent, or Firm*—Sughrue Mion, PLLC

(57) ABSTRACT

A stringed instrument includes an elongated supporter 4, which is disposed in a sound box 1 so as to have both ends fixed to a side plate 1*b* of the sound box 1, and a vibration absorber 5 disposed between the supporter 4 and a sounding board 2. The supporter 4 has a projection 4*b* formed on a surface facing an inner surface of the sounding board 2. The projection is brought into contact with the vibration absorber 5 to press the vibration absorber 5 against the inner surface of the sounding board 2. The vibration absorber 5 is supported by the supporter 4 so as not to bring both ends 5' and 5' of the vibration absorber 5 into contact with an inner surface of the side plate 1*b*.

3 Claims, 6 Drawing Sheets

STRINGED INSTRUMENT

The present invention relates to an improvement in a musical instrument, which includes a sounding board forming a sound box, and a bridge or a mount disposed thereon for supporting strings, and which makes sounds by plucking or stroking strings 6, that is to say a stringed instrument.

In most of cases, stringed instruments are played with a pickup microphone (generally called pickup) 3 mounted thereon so that sounds generated by the instruments, i.e., vibrations that are generated by plucking or stroking strings are electrically output.

Such a pickup microphone is usually mounted on the sounding board forming the sound box of a stringed instrument. Vibrations of the sounding board are electrically picked up by the pickup microphone and are output as sounds amplified through an amplifier (see JP-Y-7-31275).

However, the respective sounds that are picked up from the stringed instrument by the pickup microphone have a tendency to be longer than the original or inherent respective sounds (as in electric guitars). For this reason, it has been demanded that in a stringed instrument with a pickup microphone provided thereon, the sounds that are picked up by the microphone are brought possibly closer to the original or inherent sounds of the stringed instrument.

The primary problem that is solved by the present invention is that in a stringed instrument with a pickup microphone provided thereon, sounds that are output through the microphone are brought possibly closer to the original or inherent sounds of the stringed instrument.

In order to solve the problem, the present invention proposes configuring a stringed instrument as stated in items 1) to 5):

1) A stringed instrument has a sound box provided with a pickup microphone. 2) The stringed instrument includes a supporter disposed so as to be fixed to a side plate of the sound box inside the sound box. 3) The stringed instrument also includes a vibration absorber disposed between the supporter and a sounding board and having such a size to be brought into partial contact with an inner surface of the sounding board, the sounding board forming a front plate of the sound box. 4) The supporter has at least one projection formed on a first surface facing the inner surface of the sounding board, wherein the projection is brought into contact with the vibration absorber to press the vibration absorber against the inner surface of the sounding board. 5) The vibration absorber is supported by the supporter so as not to bring the vibration absorber into contact with an inner surface of the side plate of the sound box.

By this arrangement, vibrations generated in the sounding board can be adequately absorbed or damped by the vibration absorber. In other words, the vibration absorber adequately damps vibrations of the sounding board since the vibration absorber has such a size that the vibration absorber is brought into partial contact with the inner surface of the sounding board inside the sound box. Although the supporter is fixed to the side plate of the sound box at both ends thereof, the supporter is brought into contact with the vibration absorber through the projections. Additionally, the vibration absorber is supported so as not to be brought into contact with the inner surface of the side plate of the sound box. This arrangement minimizes the vibrations that are generated in the side plate of the sound box and are fed back to the sounding board through the supporter and the vibration absorber. Thus, the sounds that are electrically output through the pickup microphone are prevented from being longer than needed. In other words, inherent sounds of an acoustic guitar or inherent sounds of a samisen banjo are electrically output through the pickup microphone. The supporter and the vibration absorber have no adverse effect on the appearance of the sound box of the stringed instrument since the supporter and the vibration absorber are housed in the sound box.

The vibration absorber may comprise a plate-like vibration absorbing member having a first surface brought into contact with the inner surface of the sounding board, and a reinforcing plate having a first surface brought into contact with a second surface opposite to the first surface of the plate-like vibration absorbing member, the plate-like vibration absorbing member being made of a vibration absorbing material, such as rubber, a plastic material having rubber-like elasticity or felt.

In this case, the plate-like vibration absorbing member, which is made of a soft material, such as rubber, a plastic material having rubber-like elasticity or felt, can have the first surface brought into close contact with the inner surface of the sounding board, without a sag, by the reinforcing plate. Vibrations of the sounding board can be adequately damped by the plate-like vibration absorbing member.

The supporter may have an entire outer surface or a portion of an outer surface covered with a vibration absorbing material.

In this case, vibrations that are transmitted from the side plate of the sound box to the supporter can be absorbed by the vibration absorbing material covering the supporter to minimize the vibrations that are fed back to the sounding board.

In accordance with the present invention, in a stringed instrument with a pickup microphone provided thereon, sounds that are output through the microphone can be brought possibly closer to the original or inherent sounds of the stringed instrument.

Now, a typical embodiment of the present invention will be described, referring to FIGS. 1 to 6.

Figure 1:
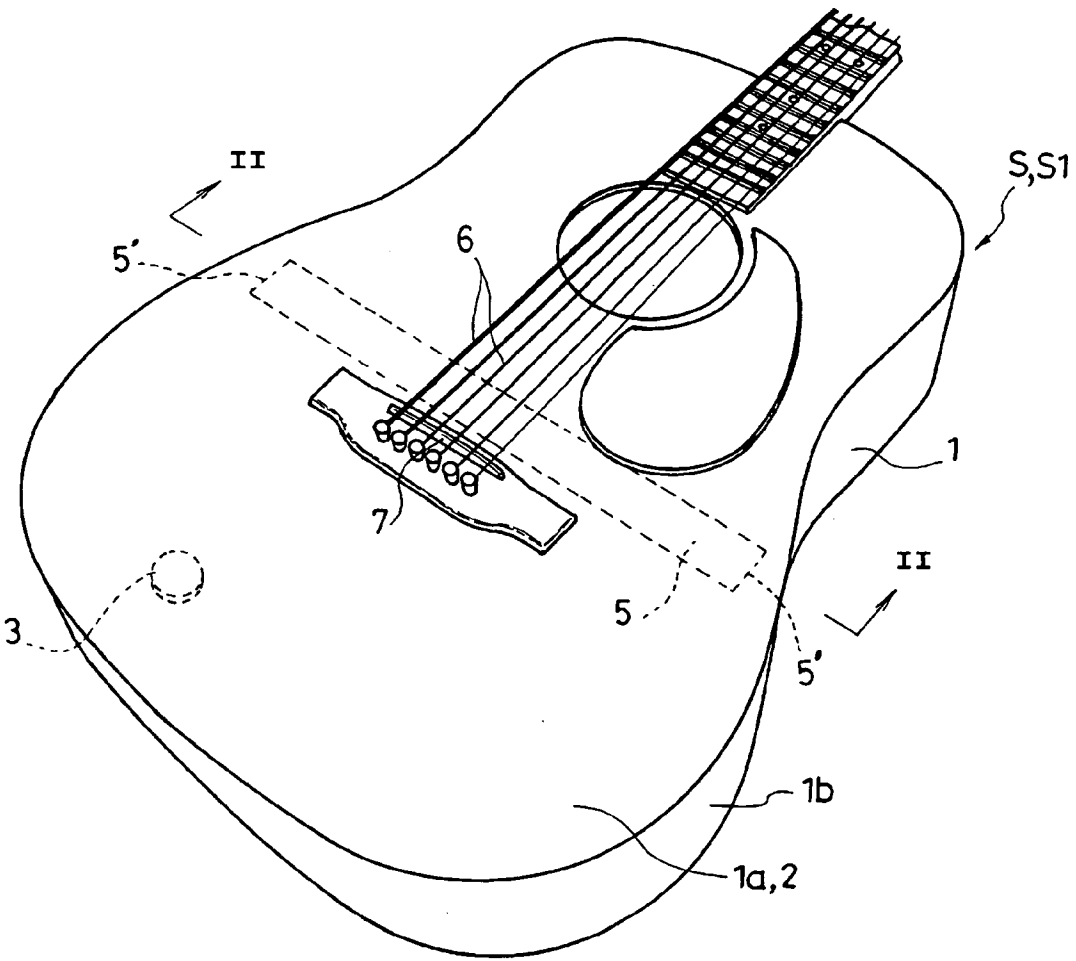
FIG. 1 is a perspective view of essential parts of a guitar with the present invention applied thereto.
Figure 2:
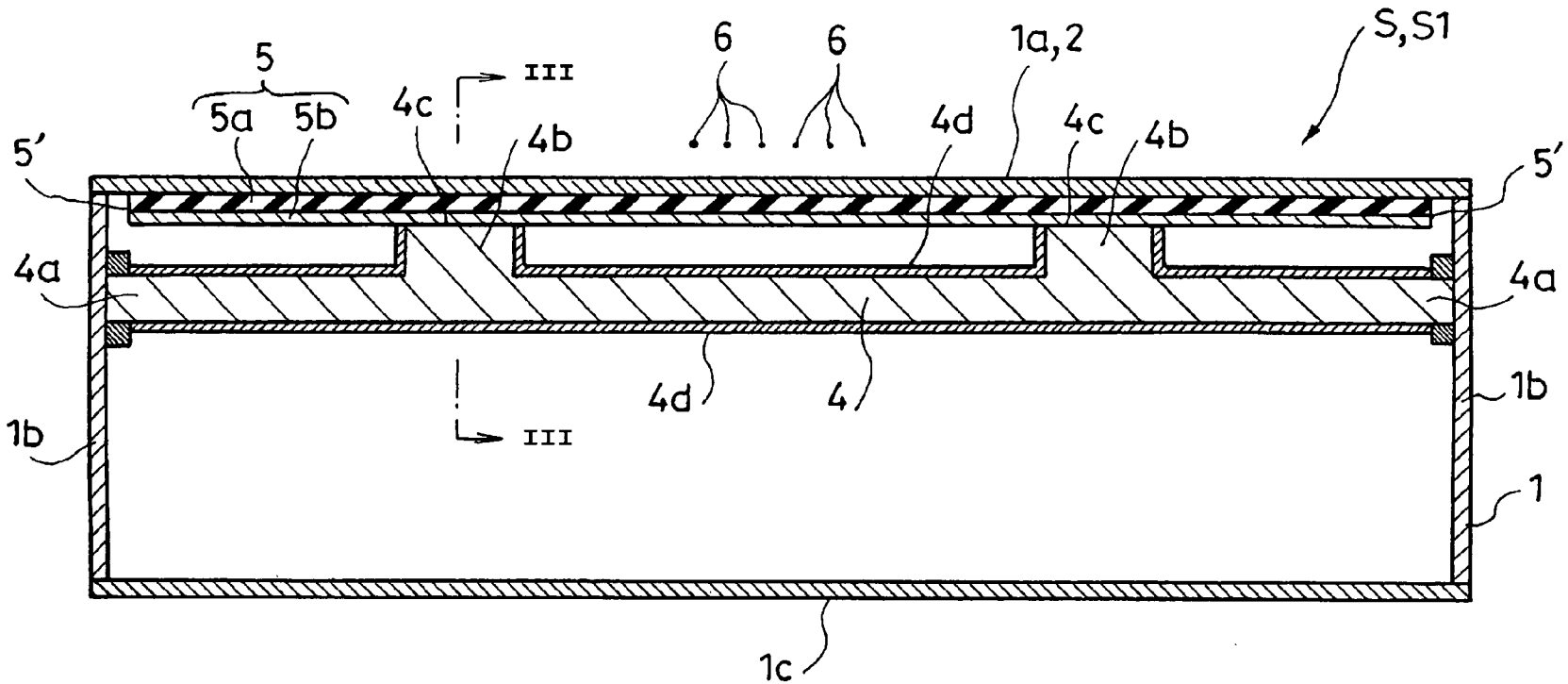
FIG. 2 is a cross-sectional view taken along the line II—II of FIG. 1.
Figure 3:
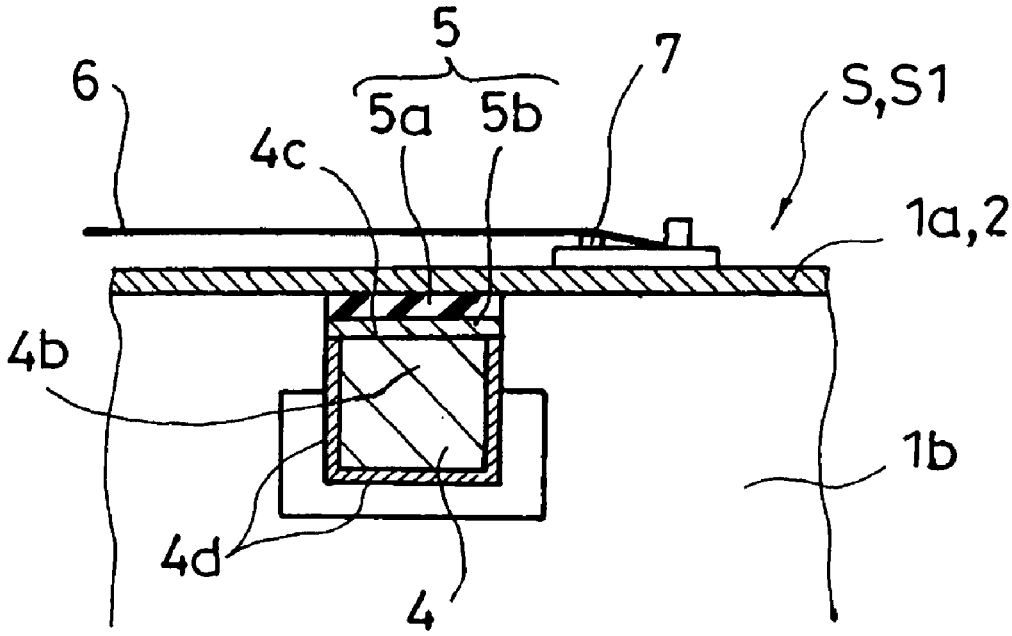
FIG. 3 is a cross-sectional view of a sound box taken along the line III—III of FIG. 2.
Figure 4:
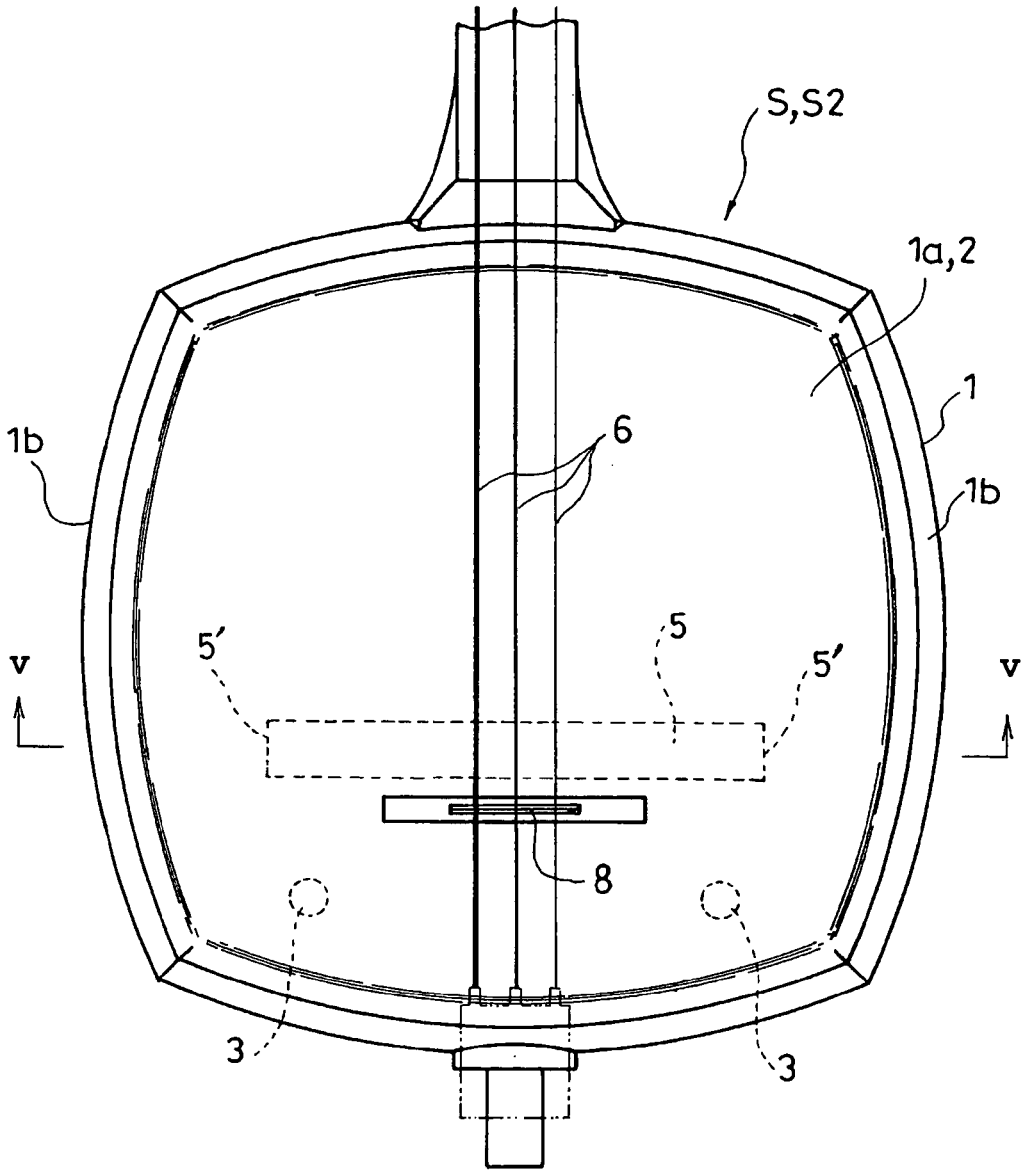
FIG. 4 is a front view of essential parts of a samisen banjo with the present invention applied thereto.
Figure 5:
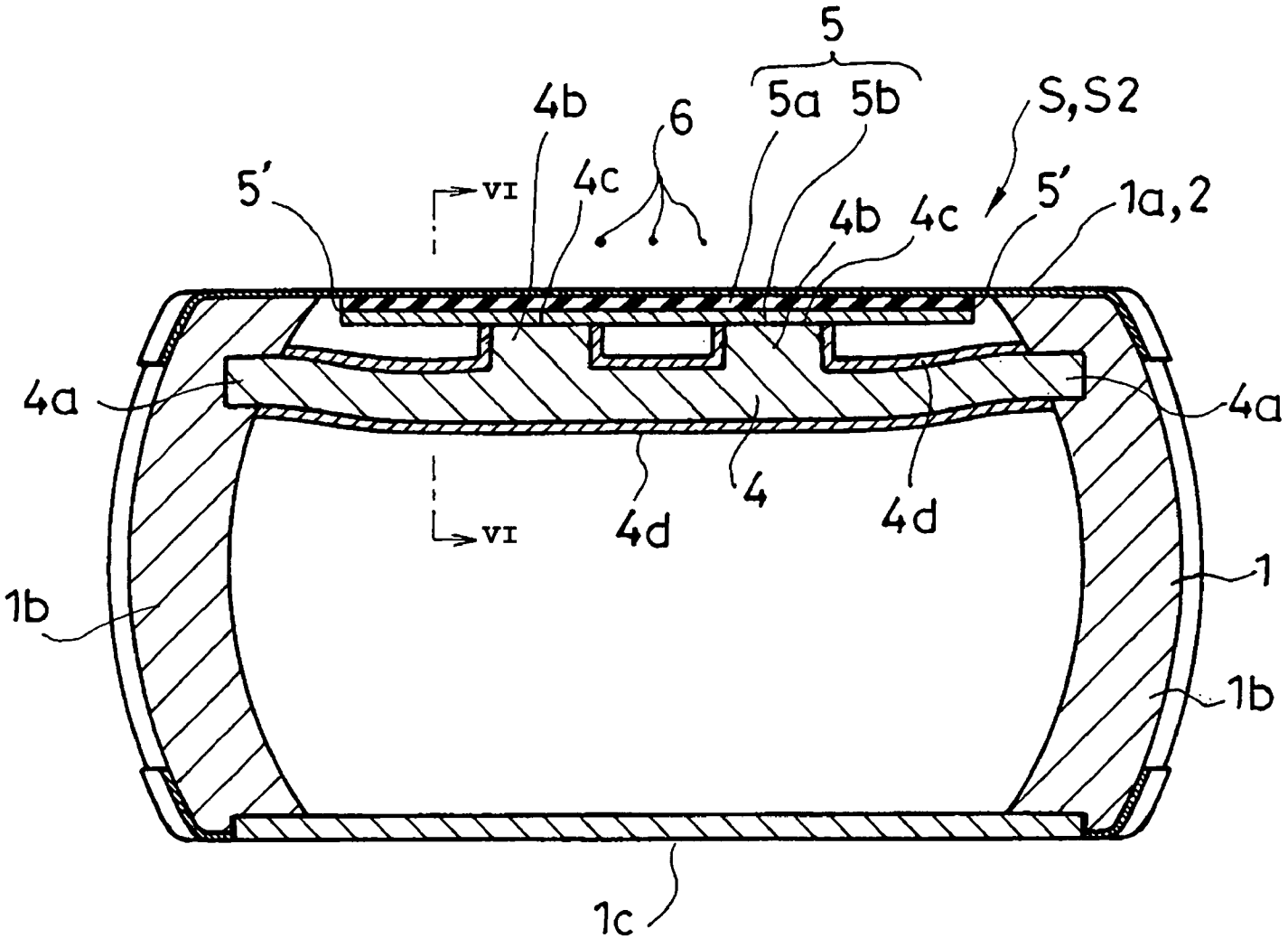
FIG. 5 is a cross-sectional view taken along the line V—V of FIG. 4.
Figure 6:
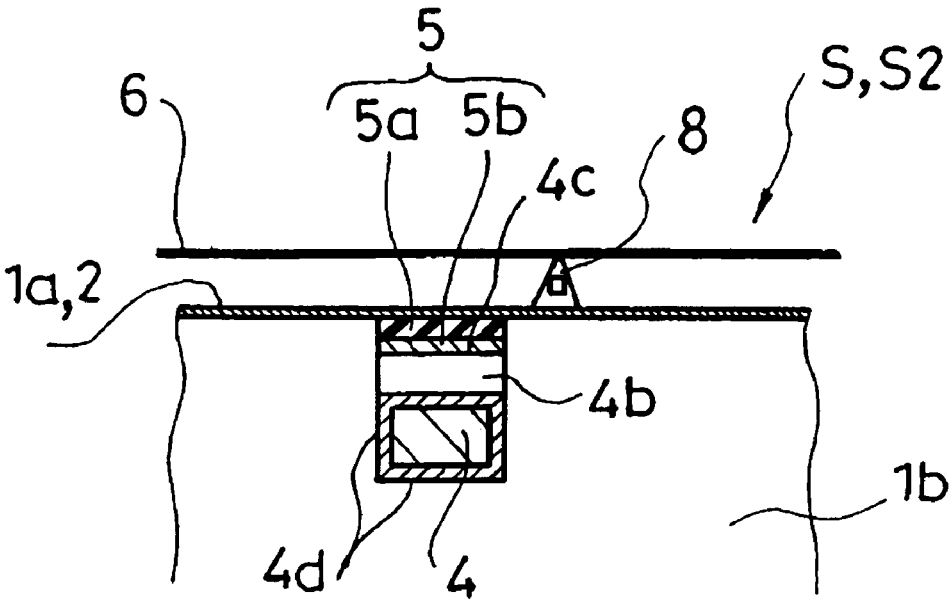
FIG. 6 is a cross-sectional view of a sound box taken along the line VI—VI of FIG. 5.

FIGS. 1 to 3 show an example wherein the present invention is applied to a guitar S1. FIGS. 4 to 6 show an example wherein the present invention is applied to a samisen banjo (or three-stringed Japanese banjo) S2. In FIG. 1, the entire guitar is shown except a head and a basic portion of a neck. In FIG. 4, the entire samisen banjo is shown except a head and a basic portion of a neck.

A stringed instrument S according to this embodiment includes a sounding board 2 forming a sound box 1, and a bridge 7 or a mount 8 disposed thereon for supporting strings (wire cords) 6. The stringed instrument S is a musical instrument, which makes sounds by plucking or stroking strings 6.

Typical examples of the stringed instrument S, to which the present invention is applicable, are an acoustic guitar, a classical guitar, a violin, a mandolin, a cello, a ukulele, a viola, a contrabass, a taishogoto (or Japanese harp), a samisen banjo (or Japanese three-stringed banjo), a jamisen (or Ryukyuan three-stringed banjo) and a biwa (or Japanese lute).

In the case of Western musical instruments, such as an acoustic guitar, the strings 6 are supported on the sound box 1 through the bridge 7. In the case of Japanese musical instruments, such as a samisen banjo and a taishogoto, the strings 6 are supported on the sound box 1 through the mount 8.

The stringed instrument S according to this embodiment includes a pickup microphone 3 on the sound box 1. The stringed instrument is configured so that vibrations of a string, which are transmitted to the sound box 2, are electrically output through the pickup microphone 3.

The stringed instrument S according to this embodiment includes a supporter 4 and a vibration absorber 5 in the sound box 1.

The supporter 4 is formed in an elongated shape. In the sound box 1, the supporter has both ends 4*a* and 4*a* fixed to a side plate 1*b* of the sound box 1.

The vibration absorber 5 is disposed between the supporter 4 and the sounding board 2 and is configured so as to extend in a direction along a longitudinal direction of the supporter 4.

The supporter 4 has one or more projections 4*b* and 4*b* formed on a first surface facing an inner surface of the sounding board 2. The supporter has the projections 4*b* brought into contact with the vibration absorber 5 to press the vibration absorber 5 against the inner surface of the sounding board 2.

The vibration absorber 5 is formed so as to have such a length that the vibration absorber dose not have both ends 5' and 5' brought into contact with an inner surface of the side plate 1*b* of the sound box 1.

The vibration absorber 5 is supported by the supporter 4 so that that the vibration absorber dose not have both ends 5' and 5' brought into contact with the inner surface of the side plate 1*b* of the sound box 1.

In the stringed instrument S according to this embodiment, vibrations generated in the sounding board 2 can be adequately absorbed or damped by the vibration absorber 5. In other words, the vibration absorber 5 adequately damps vibrations of the sounding board 2 since the vibration absorber 5 has such a size that the vibration absorber is brought into partial contact with the inner surface of the sounding board 2 inside the sound box 1. Although the supporter 4 is fixed to the side plate 1*b* of the sound box 1 at both ends thereof 4*a* and 4*a*, the supporter 4 is brought into contact with the vibration absorber 5 through the projections 4*b* and 4*b*. Additionally, the vibration absorber 5 is supported so as not to be brought into contact with the inner surface of the side plate 1*b* of the sound box 1. This arrangement minimizes the vibrations that are generated in the side plate 1*b* of the sounding board 1 and are fed back to the sounding board 2 through the supporter 4 and the vibration absorber 5. Thus, the sounds that are electrically output through the pickup microphone 3 are prevented from being longer than needed. Specifically, a sound that is electrically output through the pickup microphone 3 can be possibly closer to the sound that is inherently or originally generated by the stringed instrument S, i.e., the inherent or original sound (the sound that is inherently transmitted from the sound box 1 of the stringed instrument S by air vibration, not through the pickup microphone 3). In other words, inherent sounds of an acoustic guitar S1 or inherent sounds of a samisen banjo S2 can be electrically output through the pickup microphone.

As stated earlier, one example of the guitar S1 with the present invention applied thereto is shown in FIGS. 1 to 3.

The guitar S1 includes a sound box 1 (body), which comprises a front plate indicated by reference numeral 1*a*, a rear plate indicated by reference numeral 1*c* and a side plate 1*b*. The front plate 1*a* works as a sounding board 2. In this example, the sounding board 2 has a pickup microphone 3 provided on an inner surface thereof.

The supporter 4 in this example is formed in an elongated bar-shape. In this example, the supporter 4 has both ends 4*a* and 4*a* fixed so as to be, respectively, fitted into sockets, which are formed on portions of the side plate 1*b* of the sound box 1 extending in a longitudinal direction of the guitar S1. The supporter 4 is disposed so as to extend in a transverse direction of the sound box 1 of the guitar. The supporter 4 has a first surface formed with two projections 4*b* and 4*b*, which project toward an inner surface of the sounding board and are spaced from each other between both ends 4*a* and 4*a*. In this example, each of the projections 4*b* has a projected end surface 4*c* formed in a flat surface in substantially parallel with the inner surface of the sounding board 2. In this example, the distance between the projected end surface 4*c* of each of the projections 4*b* and the inner surface of the sounding board 2 is set so as to be substantially equal to the thickness of a vibration absorber 5. The supporter 4 has a second surface opposite to the first surface with the projections 4*b* spaced from the rear plate 1*c* of the sound box 1.

In this example, the vibration absorber 5 is formed in an elongated plate-shape so as to extend the transverse direction of the sound box 1 of the guitar. The vibration absorber 5 has a length set so as to be shorter than the length of the supporter 4. In this example, the vibration absorber 5 is supported from below by the projections 4*b* of the supporter 4 in such a state that the vibration absorber 5 has an upper surface brought into close contact with the inner surface of the sounding board 2 and that both ends 5' and 5' are not brought into contact with an inner surface of the side plate 1*b* of the sound box 1.

In this example, the vibration absorber 5 comprises a plate-like vibration absorbing member 5*a*, which has a first surface brought into contact with the inner surface of the sounding board 2 and is made of a vibration absorbing material, such as rubber, a plastic material having rubber-like elasticity or felt, and a reinforcing plate 5*b*, which has a first surface brought into contact with a second surface opposite to the first surface of the plate-like vibration absorbing member 5*a*.

In this example, the plate-like vibration absorbing member 5*a* and the reinforcing plate 5*b* are specifically formed as elongated plates, which have substantially the same length and width as each other. The vibration absorber 5 is formed by putting the plate-like vibration absorbing member 5*a* on the reinforcing plate 5*b* in layers. The second surface of the plate-like vibration absorbing member 5*a* may be merely abutted on or fixed to the first surface of the reinforcing plate 5*b* by, e.g., bonding. In this example, the projected end surfaces 4*c* of the projections 4*b* of the supporter 4 are pressed from below against a second surface opposite to the first surface of the reinforcing plate 5*b*. By this arrangement, the vibration absorber 5, which comprises the plate-like vibration absorbing member 5*a* and the reinforcing plate 5*b*, is supported from below by the projections 4*b* of the supporter 4 as stated earlier. As the reinforcing plate 5*b*, a wood plate, a woody plate, a plastic plate or the like may be utilized.

In this example, the plate-like vibration absorbing member 5*a*, which comprises a soft material, such as rubber, a plastic material having rubber-like elasticity or felt, can have the first surface brought into close contact with the inner surface of the sounding board 2, without a sag, by using the reinforcing plate 5*b* in this manner.

In this embodiment, the supporter 4 has an outer surface covered with a vibration absorbing material 4*d*.

Specifically, the entire outer surface of the supporter 4, which extends in a longitudinal direction thereof, is covered with cloth made of felt, except for the projected end surfaces 4*c* of the projections 4*b* of the supporter 4 in this example.

In this example, since vibrations that are transmitted from the side plate 1*b* of the sound box 1 to the supporter 4 are absorbed by the vibration absorbing material 4*d* covering the supporter 4 in this manner, it is possible to minimize the vibrations that are fed back to the sounding board 2.

As stated earlier, one example of the samisen banjo S2 with the present invention applied thereto is shown in FIGS. 4 to 6.

The samisen banjo S2 includes a sound box (body) 1, which comprises a front plate indicated by reference numeral 1*a*, a rear plate indicated by reference numeral 1*c* and a side plate 1*b*. The front plate 1*a* works as a sounding board 2. In this example, the sounding board 2 has two pickup microphones 3 and 3 provided on an inner surface thereof.

The supporter 4 in this example is also formed in an elongated bar-shape. In this example, the supporter 4 has both ends 4*a* and 4*a* fixed so as to be fitted in sockets, which are formed on portions of the side plate 1*b* of the sound box 1 extending a longitudinal direction of the samisen banjo S2. The supporter 4 is disposed so as to extend in a transverse direction of the sound box 1 of the samisen banjo. The supporter 4 has a first surface formed with two projections 4*b* and 4*b*, which project toward an inner surface of the sounding board 2 and are spaced from each other between both ends 4*a* and 4*a*. In this example, each of the projections 4*b* has a projected end surfaces 4*c* formed as a flat surface substantially in parallel with the inner surface of the sounding board 2. In this example, the distance between the projected end surface 4*c* of each of the projections 4*b* and the inner surface of the sounding board 2 is set so as to be substantially equal to the thickness of a vibration absorber 5. The supporter 4 has a second surface opposite to the first surface with the projections 4*b* spaced from the rear plate 1*c* of the sound box 1.

In this example, the vibration absorber 5 is formed in an elongated plate-like shape extending the transverse direction of the sound box 1 of the samisen banjo. The vibration absorber 5 has a length set so as to be shorter than the length of the supporter 4. In this example, the vibration supporter 5 is supported from below by the projections 4*b* of the supporter 4 in such a state that the vibration absorber 5 has an upper surface brought into close contact with the inner surface of the sounding board 2 and that both ends 5' and 5' are not brought into contact with an inner surface of the side plate 1*b* of the sound box 1.

In this example as well, the vibration absorber 5 comprises a plate-like vibration absorbing member 5*a*, which has a first surface brought into contact with the inner surface of the sounding board 2 and is made of a vibration absorbing material, such as rubber, a plastic material having rubber-like elasticity or felt, and a reinforcing plate 5*b*, which has a first surface brought into contact with a second surface opposite to the first surface of the plate-like vibration absorbing member 5*a*.

Specifically, the plate-like vibration absorbing member 5*a* and the reinforcing plate 5*b* are formed as elongated plates, which have substantially the same length and width as each other in this example. The vibration absorber 5 is formed by putting the plate-like vibration absorbing member 5*a* on the reinforcing plate 5*b* in layers. The second surface of the plate-like vibration absorbing member 5*a* may be merely abutted to or fixed to the first surface of the reinforcing plate 5*b* by, e.g., bonding. In this example, the projected end surfaces 4*c* of the projections 4*b* of the supporter 4 are pressed from below against a second surface opposite to the first surface of the reinforcing plate 5*b*. By this arrangement, the vibration absorber 5, which comprises the plate-like vibration absorbing member 5*a* and the reinforcing plate 5*b*, are supported from below by the projections 4*b* of the supporter 4 as stated earlier. As the reinforcing plate 5*b*, a wood plate, a woody plate, a plastic plate or the like may be utilized.

In this example, the plate-like vibration absorbing member 5*a*, which is made of a soft material, such as rubber, a plastic material having rubber-like elasticity or felt, can have the first surface brought into close contact with the inner surface of the sounding board 2, without a sag, by using the reinforcing plate 5*b* in this manner.

In this example, the supporter 4 has an outer surface covered with a vibration absorbing material 4*d*.

Specifically, the entire outer surface of the supporter 4, which extends in a longitudinal direction thereof, is covered with cloth made of felt except for the projected end surfaces 4*c* of the projections 4*b* of the supporter 4 in this example.

In this example, since vibrations that are transmitted from the side plate 1*b* of the sound box 1 to the supporter 4 are absorbed by the vibration absorbing material 4*d* covering the supporter 4 in this manner, it is possible to minimize the vibrations that are fed back to the sounding board 2.

The entire disclosure of Japanese Patent Application No. 2003-314527 filed on Sep. 5, 2003 including specification, claims, drawings and summary is incorporated herein by reference in its entirety.

What is claimed is:

1. A stringed instrument, which has a sound box provided with a pickup microphone, comprising:

a supporter disposed so as to be fixed to a side plate of the sound box inside the sound box;

a vibration absorber disposed between the supporter and a sounding board and having such a size to be brought in partial contact with an inner surface of the sounding board, the sounding board forming a front plate of the sound box; and the supporter having at least one projection formed on a first surface facing the inner surface of the sounding board, wherein the at least one projection is brought into contact with the vibration absorber to press the vibration absorber against the inner surface of the sounding board; and wherein the vibration absorber is supported by the supporter so as not to bring the vibration absorber into contact with an inner surface of the side plate of the sound box.

2. The stringed instrument according to claim 1, wherein the vibration absorber comprises a plate-like vibration absorbing member having a first surface brought into contact with the inner surface of the sounding board, and a reinforcing plate having a first surface brought into contact with a second surface opposite to the first surface of the plate-like vibration absorbing member, the plate-like vibration absorbing member being made of a vibration absorbing material, selected from the group consisting of rubber, a plastic material having rubber-like elasticity and felt.

3. The stringed instrument according to claim 1, wherein the supporter has an entire outer surface or a portion of an outer surface covered with a vibration absorbing material.

* * * * *